US006760448B1

(12) United States Patent
Gundry

(10) Patent No.: US 6,760,448 B1
(45) Date of Patent: Jul. 6, 2004

(54) COMPATIBLE MATRIX-ENCODED SURROUND-SOUND CHANNELS IN A DISCRETE DIGITAL SOUND FORMAT

(75) Inventor: Kenneth James Gundry, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 09/245,573

(22) Filed: Feb. 5, 1999

(51) Int. Cl.[7] ..... H04R 5/00

(52) U.S. Cl. ..... 381/23; 381/20; 381/22; 381/306; 381/307

(58) Field of Search ..... 381/20–23, 306, 381/307

(56) References Cited

U.S. PATENT DOCUMENTS

| | | | | | |
|---|---|---|---|---|---|
| 3,890,466 | A | * | 6/1975 | Bauer | 381/23 |
| 4,236,039 | A | * | 11/1980 | Cooper | 381/23 |
| 4,392,019 | A | | 7/1983 | Halliday | 179/1 GQ |
| 4,799,260 | A | | 1/1989 | Mandell et al. | 381/22 |
| 5,594,800 | A | | 1/1997 | Gerzon | 381/20 |
| 5,642,423 | A | | 6/1997 | Embree | 381/22 |
| 5,802,181 | A | * | 9/1998 | Ozaki et al. | 381/18 |
| 5,818,941 | A | | 10/1998 | Embree | 381/22 |

FOREIGN PATENT DOCUMENTS

| | | |
|---|---|---|
| EP | 0858243 | 12/1998 |
| GB | 1468179 | 3/1977 |

OTHER PUBLICATIONS

Leyshan, Peter True Surround Sound [online], 1995 [retrieved on Jan. 22, 1999]. Retrieved from the Internet:<URL: http://www.geocities.com/ResearchTriangle/7035/ac3page.html> (Provided by Applicant in IDS, paper 4).*

Dressler, Roger, *Dolby Pro Logic Surround Decoder Principles of Operation*, Dolby Laboratories Information # S93/8624/9827, San Francisco, CA, 1988, 1993.

Dressler, Roger, *Dolby Pro Logic Surround Decoder Principles of Operation*, published at website address: http://www.dolb.com/tech/whtppr.html., Dolby Laboratories, 1997.

Leyshan, P., *True Surround Sound*, published at website address: http://www.geocities.com/ResearchTriangle/7035/ac3page.html, 1995.

* cited by examiner

*Primary Examiner*—Minsun Oh Harvey
*Assistant Examiner*—Tony M. Jacobson
(74) *Attorney, Agent, or Firm*—Gallagher & Lathrop; Thomas A. Gallagher

(57) ABSTRACT

Three surround sound channels are provided within the current formats of the Dolby Digital, Sony SDDS and DTS digital soundtrack systems in a manner that provides compatibility with conventional two surround channel playback in standard 5.1 channel and 7.1 channel systems while allowing the soundtrack preparer to send the same signal to all surround sound channels and preserving the ability to pan among the three matrix decoded surround sound channels in an arrangement that employs an active matrix decoder to provide the three surround sound channels.

20 Claims, 3 Drawing Sheets

COMPATIBLE MATRIX-ENCODED SURROUND-SOUND CHANNELS IN A DISCRETE DIGITAL SOUND FORMAT

INCORPORATION BY REFERENCE

Each of the following United States Patents is hereby incorporated by reference in its entirety: U.S. Pat. Nos. 4,799,260; 5,046,098; 5,155,510; 5,319,713; 5,386,255; 5,450,146; 5,451,942; 5,453,802; 5,550,603; 5,544,140; 5,583,962; 5,600,617; 5,602,923; 5,621,489; 5,639,585; 5,642,423; 5,710,752; 5,717,765; 5,757,465; and 5,818,941.

FIELD OF THE INVENTION

This invention relates to the field of multichannel audio. More particularly the invention relates to matrix-encoded surround-sound channels in a discrete typically digital sound format for motion picture soundtracks.

DESCRIPTION OF RELATED ART

Optical soundtracks for motion pictures were first demonstrated around the turn of the century, and since the 1930's have been the most common method of presenting sound with motion pictures. In modern systems, the transmission of light through the film is modulated by variations in soundtrack width, where an ideally transparent varying width of soundtrack is situated within an ideally opaque surrounding. This type of soundtrack is known as "variable area".

In an effort to reduce distortion due to non-uniform light over the soundtrack width and other geometric distortion components, the "bilateral" variable area track was introduced. This format has two modulated edges, identical mirror images around a fixed centerline. A later development, which is now the standard monophonic analog optical soundtrack format, is called "dual bilateral" (or "double bilateral" or "duo-bilateral") sound track. This format has two bilateral elements within the same soundtrack area, thus providing further immunity from illumination non-uniformity errors. A useful discussion of the history and potential of optical soundtracks can be found in "The Production of Wide-Range, Low-Distortion Optical Sound Tracks Utilizing the Dolby Noise Reduction System" by Ioan Allen in *J. SMPTE*, September 1975, Volume 84, pages 720–729.

In the mid 1970's Stereo Variable Area (SVA) tracks became increasingly popular, in which two independently modulated bilateral soundtracks are situated side by side in the same area as the normal monophonic (mono) variable area track.

In 1976, Dolby Laboratories introduced its four-channel stereo-optical version of Dolby Stereo, which employed audio matrix encoding and decoding in order to carry 4 channels of sound on the two SVA optical tracks. "Dolby" and "Dolby Stereo" are trademarks of Dolby Laboratories Licensing Corporation. Dolby Stereo for SVA optical tracks employs the "MP" matrix, a type of 4:2:4 matrix system that records four source channels of sound (left, right, center and surround) on the two SVA tracks and reproduces four channels. Although the original Dolby Stereo stereo-optical format employed Dolby A-type analog audio noise reduction, in the mid-1980's Dolby Laboratories introduced an improved analog audio processing system, Dolby SR, which is now used in Dolby Stereo optical soundtrack films.

Multichannel motion picture sound was employed commercially at least as early as "Fantasound" in which the four-channel soundtrack for the motion picture Fantasia was carried in respective optical tracks on a separate film synchronized with the picture-carrying film. Subsequently, in the 1950s, various "magnetic stripe" techniques were introduced in which multiple channels of sound were recorded in separate tracks on magnetizable materials affixed to the picture-carrying film. Typically, magnetic striped 35 mm film carried three or four separate soundtracks while magnetic striped 70 mm film carried six separate soundtracks.

Although most motion picture films with magnetic striped soundtracks carried a separate channel in each magnetic track, at least one film released in the mid-1970s (Tommy in "Quintaphonic" sound) employed matrix encoding—the normally left and right tracks were matrix encoded with left front, left rear, right front and right rear sound channels. The third, center channel remained discrete. The phase sensitive matrix system suffered from sound image wandering due to variations in phasing between the matrix-encoded tracks.

In a variation of PerspectaSound used in some prints of the motion picture Around the World in Eighty Days, four magnetic tracks on 35 mm carried left, center, right and surround channel information, respectively. In addition to the surround information, the fourth track carried subaudible tones for directing the surround sound to a selected bank of three banks of surround sound loudspeakers. Early forms of PerspectaSound employed a subaudible control tone on the monaural soundtrack in order to direct the sound to selected loudspeakers behind the screen.

Magnetic striped 35 mm films became obsolete after the introduction of the Dolby Stereo 35 mm optical format.

In another version of Dolby Stereo introduced in the 1970s, Dolby noise reduction was applied to four of the six discrete audio tracks of magnetic striped 70 mm motion picture film. As a feature of this Dolby Stereo format, tracks 1 and 2 (recorded in the magnetic stripe located between the left edge of the film and the left-hand sprocket holes) carry the left main screen channel and low-frequency-only "bass extension" information, respectively; track 3 (recorded in the magnetic stripe located between the left-hand sprocket holes and the picture) carries the center main screen channel; track 4 (recorded in the magnetic stripe located between the picture and the right-hand sprocket holes) also carries low-frequency-only "bass extension" information; and tracks 5 and 6 (recorded in the magnetic stripe located between the right sprocket holes and the right edge of the film) carry the right main screen channel and the single surround channel, respectively. Dolby noise reduction is not applied to the bass extension information.

In a variation of Dolby Stereo for 70 mm magnetic soundtrack motion picture films, two surround channels are provided instead of one (referred to as "split surrounds" or "stereo surrounds"). Tracks 1, 3, 5 and 6 are the same as in conventional Dolby Stereo 70 mm; however, mid- and high-frequency left surround information is recorded (with Dolby noise reduction) in track 2 along with the low-frequency bass information, and mid- and high-frequency right surround information is recorded (with Dolby noise reduction) in track 4 along with the low-frequency bass information. When reproduced in a theater, the mid- and high-frequency stereo surround information on tracks 2 and 4 is fed to the left and right surround speakers, respectively, combined with monophonic surround bass information from track 6. This variation of Dolby Stereo 70 mm was an early form of the now-common "5.1" channel (sometimes referred to as six channel) configuration: left, center, and right main screen channels, left and right surround sound channels and a low-frequency bass enhancement (LFE) or subwoofer channel. The LFE channel, which carries much less information than the other full-bandwidth channels, is now referred to as ".1" channels.

In spite of these advances in analog soundtrack fidelity, film soundtracks had long been considered a candidate for digital coding due to the high cost of 70 mm magnetic soundtrack films and the perceived limitations of the matrix technology employed in 35 mm optical soundtrack films. In 1992, Dolby Laboratories introduced its Dolby Digital optical soundtrack format for 35 mm motion picture film. Dolby Digital is a trademark of Dolby Laboratories Licensing Corporation. 5.1 channel (left, center, right, left surround, right surround and LFE) soundtrack information is digitally encoded employing Dolby Laboratories AC-3 perceptual encoding scheme. That encoded information is in turn encoded as blocks of symbols optically printed between the film's sprocket holes along one side of the film. The analog SVA tracks are retained for compatibility. Details of the Dolby Digital 35 mm film format are set forth in U.S. Pat. Nos. 5,544,140, 5,710,752 and 5,757,465. The basic elements of the Dolby AC-3 perceptual coding scheme are set forth in U.S. Pat. No. 5,583,962. Details of a practical implementation of Dolby AC-3 are set forth in Document A/52 of the United States Television Systems Committee (ATSC), "Digital Audio Compression Standard (AC-3)," Dec. 20, 1995 (available on the world wide web of the Internet at3 atsc dot org and at dolby dot com. The Dolby Digital system typically provides the channel discreteness of 70 mm magnetic soundtrack films while preserving the low cost and compatibility of 35 mm optical soundtrack films.

Subsequently, in 1993, Sony introduced its Sony Dynamic Digital Sound (SDDS) format for 35 mm motion picture film. In the SDDS system "7.1" channel (sometimes referred to as eight channel) (left, left center, center, right center, right, left surround, right surround and LFE) soundtrack information is digitally encoded using a form of Sony's ATRAC perceptual coding. That encoded information is in turn encoded as strips of symbols optically printed between each edge of the film and the nearest sprocket holes. Sony, Sony Dynamic Digital Sound, SDDS, and ATRAC are trademarks. Some details of the Sony SDDS system are set forth in U.S. Pat. Nos. 5,550,603; 5,600,617; and 5,639,585.

Also in 1993, Digital Theater Systems Corporation ("DTS") introduced a separate medium digital soundtrack system in which the 35 mm motion picture film carries a time code track for the purpose of synchronizing the picture with a CD-ROM encoded using a type of perceptual coding with 5.1 channel soundtrack information (left, center, right, left surround, right surround and LFE). DTS is a trademark. Some details of the DTS system are set forth in U.S. Pat. Nos. 5,155,510; 5,386,255; 5,450,146; and 5,451,942.

Further details of the Dolby Digital, Sony SDDS and DTS systems are set forth in "Digital Sound in the Cinema" by Larry Blake, *Mix*, October 1995, pp. 116, 117, 119, 121, and 122.

FIG. 1 shows an idealized loudspeaker arrangement for a typical theater 10 employing the Dolby Digital or the DTS 5.1 channel systems. The left channel soundtrack L is applied to left loudspeaker(s) 12, the center channel soundtrack C is applied to the center loudspeaker(s) 14 and the right channel soundtrack R is applied to the right loudspeaker(s) 16, all of which loudspeakers are located behind the motion picture screen 18. These may be referred to as main screen channels. The left surround channel $L_S$ is applied to left surround loudspeaker(s) 20 shown at the rear portion of the left wall 22 of the theater. The right surround channel $R_S$ is applied to right surround loudspeaker(s) 24 shown at the rear portion of the right wall 26 of the theater. In normal practice, there are a plurality of left surround loudspeakers spaced along the left side wall of the theater starting from a location about midway between the front and rear of the theater and extending to the rear wall 28 and then along the rear wall to a location near the mid-point of the rear wall. The right surround loudspeakers are arranged along the along the right side wall and rear wall in a mirror image of the left surround loudspeaker arrangement. In addition, low frequency effect (LFE) or subwoofer loudspeakers (not shown), carrying non-directional low frequency sound, are usually located behind the screen 18, but may be located elsewhere. For simplicity, no LFE or subwoofer loudspeakers are shown in any of the drawings.

FIG. 2 shows an idealized loudspeaker arrangement for a typical theater 10 employing the Sony SDDS 7.1 channel system. The arrangement is the same as shown in FIG. 1 for the Dolby and DTS systems with the exception that the Sony SDDS system provides two additional main screen channels—a left center channel LC that is applied to left center loudspeaker(s) 13 and a right center channel RC that is applied to right center loudspeaker(s) 15.

All three digital motion picture sound systems provide at least three discrete main screen channels and two discrete surround sound channels. Although two surround sound channels are sufficient to satisfy the creators of and audiences for most multichannel sound motion pictures, there are, nevertheless, desires for more than two surround sound channels for some motion pictures.

The desire for more than two surround sound channels is addressed in two related patents (U.S. Pat. Nos. 5,602,923 and 5,717,765) that disclose an approach for providing additional surround-sound channels to the 7.1 channel Sony SDDS system. The patents point out that the SDDS system is "pushing the bandwidth limits of current motion picture technology in order to obtain the eight channels of information" and that "additional tracks are beyond the current practical bandwidth available on conventional motion picture film unless main or surround channel bandwidth is sacrificed."

The 5,602,923 and 5,717,765 patents add one or more very high frequency tones to the left surround and right surround channels in order to direct all or a portion of the information in a respective surround channel from the normal left surround and right surround loudspeakers to loudspeakers above the audience and above the motion picture screen. However, a shortcoming of that approach is its inability to reproduce different surround sound channels simultaneously from each of the more than two banks of surround sound loudspeakers. In other words, at any one time there are only two possible surround sound channels even though the loudspeaker locations that produce those channels may be varied.

In copending U.S. patent application Ser. No. 09/072,707 of Raymond E. Callahan and loan R. Allen, filed May 5, 1998, entitled "Matrix-Encoded Surround-Sound Channels in a Discrete Digital Sound Format" and assigned to the assignee of the present application, solutions to providing more than two surround sound channels within the current formats of the Dolby Digital, Sony SDDS and DTS digital soundtrack systems are set forth. A preferred embodiment of said application shown in FIG. 3 herein (and in FIG. 3 of said application) shows an idealized loudspeaker arrangement for a typical theater 10 employing three surround channels. Although only three main screen loudspeaker channels (L, C and R) are shown in FIG. 3, it is to be understood that five main screen loudspeaker channels (L, LC, C, RC and R) may be employed as in the manner of FIG. 2. The left surround and right surround channel audio streams from the Dolby Digital, Sony SDDS or DTS digital soundtrack decoding apparatus are applied to a 2:3 matrix decoder 32 as its $L_{TS}$ (left total surround) and $R_{TS}$ (right total surround) inputs. In this case, the left total surround and right total surround channel audio streams have been 3:2 matrix encoded with left surround ($L_S$), right surround ($R_S$) and back surround ($B_S$) audio inputs prior to the production of the respective Dolby Digital, Sony SDDS or DTS digital soundtrack. In other words, the $L_S$, $R_S$ and $B_S$ audio inputs are 3:2 matrix encoded into two surround audio inputs and those two surround audio inputs are applied along with the main screen and LFE inputs to the normal Dolby Digital, Sony SDDS or DTS digital soundtrack encoding and recording apparatus (not shown). The three de-matrixed surround sound channels $L_S$, $R_S$ and $B_S$ from decoder 32 are applied to the left surround loudspeaker(s) 34, the right surround loudspeaker(s) 38 and the back surround loudspeaker(s) 36, respectively. The surround loudspeaker locations are shown in idealized positions. In normal practice, there are a bank (i.e., plurality) of left surround loudspeakers spaced along the left side wall of the theater starting from a location about midway between the front and rear of the theater and extending to the rear wall 28. A bank of right surround loudspeakers are spaced along the along the right side wall in a mirror image of the left surround loudspeaker arrangement and a bank of back surround loudspeakers are spaced along the rear wall 28 of the theater.

In practice, prior to the present invention, the 2:3 matrix decoder 32 in the FIG. 3 environment has used the left (L), center (C) and right (R) inputs of a 2:4 active MP ("MP" is a trademark of Dolby Laboratories Licensing Corporation) matrix decoder described in U.S. Pat. No. 4,799,260 and in "Dolby Pro Logic Surround Decoder Principles of Operation" by Roger Dressler, available on the Internet at dolby dot com and also distributed by Dolby Laboratories, Inc. as publication S93/8624/9827 (see also description below). No signals are applied to the "S" encoder input. Consumer decoders employing this form of decoding bear the trademark "Pro Logic," a trademark of Dolby Laboratories Licensing Corporation. Professional cinema processors manufactured by Dolby Laboratories, Inc. employing this form of decoding include the Dolby CP45, the Dolby CP65 and the Dolby CP500 Cinema Processor. Digital versions of the Pro Logic decoder are also known—see for example U.S. Pat. Nos. 5,642,423 and 5,818,941 that describe digitally implemented Pro Logic active matrix decoders.

FIG. 4 is an idealized functional block diagram of a conventional prior art 4:2 MP matrix passive (linear time-invariant) encoder. The encoder accepts four separate input signals; left, center, right, and surround (L, C, R, S), and creates two final outputs, left-total and right-total (Lt and Rt). The C input is divided equally and summed with the L and R inputs (in combiners 40 and 42, respectively) with a 3 dB level reduction (provided by attenuator 44) in order to maintain constant acoustic power. The L and R inputs, each summed with the level-reduced C input, are phase shifted in respective identical all-pass networks 46 and 48 located between the first combiners (40 and 42) and a second set of combiners 50 and 52 in each path. The surround (S) input is also divided equally between Lt and Rt subject to a third all-pass network 60 with a 3 dB level reduction (provided by attenuator 54), but it also undergoes two additional processing steps (which may occur in any order) in block 56:

a. frequency bandlimiting (bandpass filtering) from 100 Hz to 7 kHz; and b. encoding with a modified form of Dolby B-type noise reduction.

The output of block 56 is summed with the phase-shifted L/C path in combiner 50 to produce the Lt output and subtracted from the phase-shifted R/C path in combiner 52 to produce the Rt output. Thus, the surround input S is fed into the Lt and Rt outputs with opposite polarities. In addition, the phase of the surround signal S is about 90 degrees with respect to the LCR inputs. It is of no significance whether the surround leads or lags the other inputs. In principle there need be only one phase-shift block, say −90 degrees, in the surround path, its output being summed with the other signal paths, one in-phase (say Lt) and the other out-of-phase (inverted) (say Rt). In practice, as shown in FIG. 4, a 90 degree phase shifter is unrealizable, so three all-pass networks are used, two identical ones in the paths between the center channel summers and the surround channel summers and a third in the surround path. The networks are designed so that the very large phase-shifts of the third one are 90 degrees more or less than those (also very large) of the first two.

The left-total (Lt) and right-total (Rt) encoded signals may be expressed as $$Lt=L+0.707\,C+0.707\,jS'; \text{ and}$$

$$Rt=R+0.707\,C-0.707\,jS',$$

where L is the left input signal, R is the right input signal, C is the center input signal and S' is the band-limited and noise reduction encoded surround input signal S. In the above equations and in other equations in this document, a term (such as 0.707 jS') containing "j" represents a signal phase-shifted 90 degrees with respect to other terms. The reader will appreciate that 0.707 is 1/√2 and represents an attenuation of 3 dB.

As mentioned above, in producing digital soundtracks in which the left surround and right surround tracks are matrix encoded with three surround sound channels, the MP 4:2 encode matrix is preferably employed as a 3:2 matrix by applying no input to the encode matrix' "S" input. Thus, the MP 3:2 encode matrix is defined by the following relationships:

$$L_T=L+0.707C \quad \text{(Eqn. 1)}$$

$$R_T=R+0.707C \quad \text{(Eqn. 2)}$$

where L is the Left channel signal, R is the Right channel signal, C is the Center channel signal and S is the Surround channel signal. Thus, the matrix encoder output signals are weighted sums of the three source signals. $L_T$ and $R_T$ are the matrix output signals.

A passive MP 2:3 decode matrix is defined by the following relationships:

$$L'=L_T \quad \text{(Eqn. 3)}$$

$$R'=L_T \quad \text{(Eqn. 4)}$$

$$C'=(L_T+R_T)/\sqrt{2} \quad \text{(Eqn. 5)}$$

where L' represents the decoded Left channel signal, R' represents the decoded Right channel signal and C' represents the decoded Center channel signal. Thus, the matrix decoder forms its output signals from weighted sums of the 3:2 encoder matrix output signals $L_T$ and $R_T$.

Due to the known shortcomings of a 3:2:3 matrix arrangement, the output signals L', C', R' and S' from the decoding matrix are not exactly the same as the corresponding three input signals to the encoding matrix. This is readily demonstrated by substituting the weighted values of L, C, and R from Equations 1 and 2 into Equations 3 through 5:

$$L'=L_T=L+0.707C \quad \text{(Eqn. 3a)}$$

$$R'=R_T=R+0.707C \quad \text{(Eqn. 4a)}$$

$$C'=(L_T+R_T)/\sqrt{2}=C+0.707(L+R) \quad \text{(Eqn. 5a)}$$

The crosstalk components (0.707C) in the L' signal, etc.) are not desired but are a limitation of the basic 3:2:3 matrix technique. Preferred approaches for improving the performance of 2:3 MP matrix decoder are set forth in U.S. Pat. No. 4,799,260, which is directed to the fundamental elements of active matrix decoders known as Pro Logic decoders.

As just shown above, passive decoders are limited in their ability to place sounds with precision for all listener positions due to inherent crosstalk limitations in the audio matrix. Dolby Pro Logic active decoders employ directional enhancement techniques which reduce such crosstalk components. The use of active surround decoders is preferred with the present invention.

FIG. 5 is an idealized functional block diagram of a prior art passive surround decoder suitable for decoding Dolby MP matrix encoded signals. Understanding its operation is fundamental to understanding a Dolby Pro Logic active decoder. The heart of the passive matrix decoding process is a simple L-R difference amplifier. The Lt input signal passes unmodified and becomes the left output. The Rt input signal likewise becomes the right output. Lt and Rt also carry the center signal, so it will be heard as a "phantom" image between the left and right speakers, and sounds mixed anywhere across the stereo soundstage will be presented in their proper perspective. The center speaker is thus shown as optional since it is not needed to reproduce the center signal. The L-R stage in the decoder will detect the surround signal by taking the difference of Lt and Rt, then passing it through a 7 kHz low-pass filter, a delay line, and complementary modified Dolby B-type noise reduction. The surround signal will also be reproduced by the left and right speakers, but it will be heard out-of-phase which will diffuse the image. In order properly to reproduce the decoded surround sound signal, the surround signal is ordinarily reproduced by one or more surround speakers located to the sides of and/or to the rear of the listener.

Although this prior art passive Dolby MP matrix decoder may be used with embodiments of the present invention described below, it is preferred that embodiments of the present invention that require a matrix decoder employ an active matrix decoder, such as a Dolby Pro Logic matrix decoder.

Referring again to FIG. 5, the Lt and Rt inputs are applied to a combiner 68 that sums them to produce an optional center signal C and to a combiner 70 that subtracts R from L to produce the surround signal (S) output via an anti aliasing filter 72 an audio time delay 74, controlled by a time delay set 75, a 7 kHz low-pass filter 76, and a modified B-type NR decoder 78.

In a Pro Logic active matrix decoder, two related pairs of control signals are generated for controlling a variable matrix. One pair of control signals, the left/right dominance control signals, $F_L$ and $F_R$, is controlled by the ratios of the absolute values of the two input channel signals $L_T$ and $R_T$ (i.e., $|L_T|/|R_T|$ and $|R_T|/|L_T|$, respectively) and the other pair, the center/surround dominance control signals, $F_C$ and $F_S$, is controlled by the ratios of the absolute values of the sum and difference of the two input channel signals. Only one of the control signals at a time in each pair is allowed to vary from its quiescent condition. When all four control signals are in their quiescent condition, the variable matrix is a fixed matrix having the same characteristics as a conventional passive MP matrix. For other conditions, the decoding matrix is varied or "steered" by the control signals in order to produce decoded output channels with enhanced separation.

For a single sound source coming from only one of the cardinal directions (0 degrees, 90 degrees, 180 degrees and 270 degrees—see FIG. 2A of U.S. Pat. No. 4,799,260), only the F control signal corresponding to that cardinal direction varies from its quiescent value. Of course, a sound source may come from anywhere around the 360 degree compass, in which case one of the "F" terms in the "$F_L$, $F_R$" pair departs from its quiescent value and one of the "F" terms in the "$F_C$, $F_S$" pair also departs from its quiescent value. Thus, two "F" control signals can move simultaneously, but only if they are in a different "F" control signal pair. This is also the result when there are multiple sound sources coming from many directions. In that case, the dominant sound source in each pair controls.

It is common practice in the preparation of Dolby Digital and DTS 5.1-channel soundtracks and Sony SDDS 7.1-channel soundtracks to feed simultaneously the same sound equally into both the left and right surround channels, generally with the same polarity (phase). With ordinary 5.1 or 7.1 channel reproduction, sometimes referred to hereinafter simply as "5.1/7.1," (i.e., the two surround channels directly feed two banks of surround sound speakers instead of feeding a matrix decoder that in turn feeds more than two banks of surround speakers), this sound is reproduced from all (i.e., both) the banks of surround loudspeakers. However, when decoded by a Pro Logic active matrix decoder feeding three banks of surround loudspeakers, as in the FIG. 3 environment, the sound emerges only from the back bank of surround loudspeakers because the active matrix decoder "steers" the identical in-phase signals to the back bank of surround sound speakers, thereby defeating the intent of the soundtrack preparer. In a Pro Logic decoder, this condition, a dominance of $L_T+R_T$ over $L_T-R_T$, causes the $F_C$ control signal to depart from its quiescent value, thereby varying the matrix in such a way as to steer the signal to the "center" output, which is connected to the back surround loudspeakers. If the soundtrack preparer tries to overcome this problem by feeding the same sound equally into both the left and right surround channels but out of phase (opposite polarity), the active matrix decoder feeds the signal only to the fourth output (which is not used in the FIG. 3 environment, or, in other applications might be coupled to yet a separate bank of loudspeakers, such as overhead speakers). In a Pro Logic decoder, this condition, a dominance of $L_T-R_T$ over $L_T+R_T$, causes the $F_S$ control signal to depart from its quiescent value, thereby varying the matrix in such a way as to steer the signal to the undesired surround (S) output. Although a passive MP matrix decoder does not suffer from these problems when identical in-phase or out-of-phase sounds are received (it would provide the same signal at all four outputs for both phase conditions), the use of a passive decoder is undesirable because of its inherent crosstalk between adjacent channels.

It is known that the steering of an active matrix decoder may be disabled when the same sound is fed with equal amplitude into its inputs by "decorrelating" one input with respect to the other. Various audio signal decorrelation schemes are known in the prior art, including phase shifting, comb filtering, time delay and pitch shifting. As to phase shifting, it is known that the active matrix decoder may be disabled, rendering it a passive decoder, by shifting one of the two identical inputs relative to the other by 90 degrees (in the case of a Dolby Pro Logic decoder, the absolute values of the inputs remain identical, keeping the left and right control signals at their quiescent value, and the absolute values of the sum and difference of the two inputs become identical, thus also keeping the center and surround control signals at their quiescent values).

One solution to the problem, conceived by the present inventor, might be to add an additional input to the encoder, designated, for example, "all surround," that would apply an input signal to both encoder outputs but 90 degrees out of phase with respect to each other. While such an encoder would allow panning of a signal among the three or four conventional inputs (and hence among the corresponding active or passive decoder outputs), such an encoder would require different mixing practice, extra connections and feeds from the mixing console, and would not allow smooth panning between the conventional inputs and the "all" input. Therefore, such a solution would be impractical.

Another potential solution to the problem, known prior to the present invention, is to modify the MP matrix encoder by providing a 90 phase shift in one input path with respect to the other. For example, modify the prior art encoder of FIG. 4, described above, by inserting two additional all-pass networks, one between combiner 40 and all-pass filter 46 and the other between combiner 42 and all-pass filter 48. Alternatively, the new all-pass filters could be inserted between the left and right inputs and the combiners 40 and 42, respectively. As noted above, in practice, a 90 degree phase shifter is unrealizable, so all-pass networks with very large phase-shifts are used. The networks are designed so that the very large phase-shifts of one are 90 degrees more or less than those (also very large) of the other. However, a problem is that panning between left and back or right and back is no longer possible (whether decoded using an active or a passive matrix decoder) because of the very large phase difference between the back (center) surround channel and the left and right channels, respectively.

Yet a further potential solution to the problem is to modify the MP matrix encoder by employing another type of decorrelation in the input paths (e.g., comb filtering, time delay or pitch shifting). However, such decorrelation techniques would result in a changed spectrum (in the case of comb filtering per se or time delay, which also causes comb filtering effects) or audible beats (in the case of pitch shifting) when panning, and would likely cause the active matrix decoder to depart from its non-steered passive matrix mode for some signal conditions when the same input signal is applied to the $L_S$ and $R_S$ inputs, thus rendering such alternate decorrelation techniques undesirable.

Accordingly, there is still an unfulfilled need to provide three surround sound channels within the current formats of the Dolby Digital, Sony SDDS and DTS digital soundtrack systems in a manner that provides compatibility with conventional two surround channel playback in standard 5.1 channel and 7.1 channel systems while allowing the soundtrack preparer to send the same signal to all surround sound channels (the "all surrounds" result) and preserving the ability to pan among the three matrix decoded surround sound channels in an arrangement that employs an active matrix decoder to provide three surround sound channels.

SUMMARY OF THE INVENTION

It is an object of the present invention to provide three surround sound channels within the format of a digital soundtrack system designed to provide only two surround sound channels, with the ability, while employing an active matrix decoder, to feed a sound simultaneously to all three surround sound channels.

It is an object of the present invention to provide three surround sound channels within the format of a digital soundtrack system designed to provide only two surround sound channels, with the ability, while employing an active matrix decoder, to feed a sound simultaneously to all three surround sound channels, while preserving the compatible ability to feed the sound to both surround sound channels simultaneously in standard 5.1 channel and 7.1 channel systems.

It is a further object of the present invention to provide three surround sound channels within the format of a digital soundtrack system designed to provide only two surround sound channels, with the ability, while employing an active matrix decoder, to feed a sound simultaneously to all three surround sound channels and to pan sounds among the three surround sound channels.

It is a further object of the present invention to provide three surround sound channels within the format of a digital soundtrack system designed to provide only two surround sound channels, with the ability, while employing an active matrix decoder, to feed a sound simultaneously to all three surround sound channels and to pan sounds among the three surround sound channels, while preserving the compatible ability to pan between the two conventional surround sound channels in standard 5.1 channel and 7.1 channel systems.

In accordance with the present invention three surround sound channels are provided within the current formats of the Dolby Digital, Sony SDDS and DTS digital soundtrack systems in a manner that provides compatibility with conventional two surround channel playback in standard 5.1 channel and 7.1 channel systems while allowing the soundtrack preparer to send the same signal to all surround sound channels and preserving the ability to pan among the three matrix decoded surround sound channels in an arrangement that employs an active matrix decoder to provide the three surround sound channels.

These and other objects, advantages and features of the invention will become apparent to those skilled in the art upon consideration of the present specification, drawings and claims.

Aspects of the invention include (1) an audio encoder, (2) an audio signal decoding method, and (3) an audio encoding and decoding system.

In accordance with the first aspect of the present invention, an audio encoder has at least three audio signal inputs, input one, input two and input three, and at least two audio signal outputs, output one and output two. The audio encoder also includes an audio matrix, the matrix feeding signals applied to input one substantially only to output one, input two substantially only to output two, and input three substantially equally to outputs one and two, the signals at the outputs having phase relationships such that, over at least a portion of the audio spectrum, relative to the phase of output signals derived from the third input, the phases of signals derived from the first and second inputs, respectively, are shifted substantially by 45 degrees in opposite directions.

When the audio encoder of the first aspect of the invention is for encoding surround sounds for subsequent reproduction via an active surround matrix decoder for playing into three loudspeakers or banks of loudspeakers (to the left rear, back and right rear of an audience), the first and second signal inputs constitute inputs for left surround and right surround signals, respectively, the third signal input constitutes an input for a back surround signal, the first signal output constitute a left total surround signal output and the second signal output constitutes a right total surround signal output.

Thus, when the same signal is applied to the left surround and right surround inputs, that same signal is produced by the left total and right total output signals but with a 90 degree phase shift between the outputs. A three surround channel active matrix playback system, such as in the environment of FIG. 3, will deliver the signal to all three surround channels (a Pro Logic active matrix decoder acts as a passive matrix decoder for that signal input condition, as explained above). A conventional 5.1 or 7.1 channel reproduction will deliver the respective left total and right total signals to the left surround and right surround channels.

While providing a relative phase shift of 90 degrees between output signals resulting from an input signal applied to the left surround and right surround inputs of the decoder, the encoder of the present invention also provides a relative phase shift of +45 degrees or −45 degrees between output signals resulting from an input signal applied to the left surround or right surround input and the back surround input. This makes it possible to achieve the 5.1/7.1 compatible "all surrounds" active matrix decoding result while at the same time providing the ability to pan from left to back to right among the left, right and back surround channels in essentially the same way that three-channel panning among the three front channels has been accomplished in prior art Dolby Stereo 4:2:4 matrix productions. This panning ability also is compatible with conventional 5.1/7.1 reproduction. "Panning" includes the ability to feed a signal to only one surround sound channel and surround loudspeaker or bank of surround sound loudspeakers. Panning from left to right omitting the back input will move a sound smoothly from the left only via all loudspeakers to the right only.

Thus, an encoder in accordance with the present invention causes the following results in an environment such as FIG. 3 in which a Dolby Pro Logic active matrix decoder is employed:

a) when any of the encoder inputs is fed singly with a signal, that signal will be steered to emerge only from the corresponding output of the matrix decoder;

b) when fed with a signal on the back surround ($B_a$ input), the encoder delivers identical $L_{TS}$ and $R_{TS}$ outputs with no phase difference, causing the decoder to steer to the back output only (this is a special case of a) above);

c) when fed with identical input signals on the $L_S$ and $R_S$ inputs, it delivers $L_{TS}$ and $R_{TS}$ outputs whose phases differ by 90 degrees, causing the decoder to adopt its basic passive matrix mode of operation with no steering, and delivering signals to all outputs; and d) when fed with a signal panned from $L_S$ to $B_S$ or $B_S$ to $R_S$, the phase difference between the $B_S$ signal component in the $L_{TS}$ and $R_{TS}$ signals and the $L_S$ and $R_S$ signal components in those signals is relatively small, thus retaining a high degree of correlation among the three signals, so that pans are decoded similarly to those generated by a prior art MP matrix encoder without audibly objectionable side effects (such as beats or comb filtering effects) (note that such undesirable artifacts are caused by the mixing together of two signals that occurs during panning when decorrelation techniques other than those of the present invention are employed).

Thus, by employing properly selected phase shifting among the $L_S$, $R_S$ and $B_S$ signals in the encoder, decorrelation ("unsteering") for identical inputs is provided, while also allowing full panning, including between left and back or right and back, without significant side effects.

In accordance with the second aspect of the present invention, an audio signal decoding method comprises receiving first and second received audio signals produced by an audio encoding matrix, wherein the first received audio signal is derived from a first audio signal applied to the matrix, the second received audio signal is derived from a second audio signal applied to the matrix, and the first and second received audio signals are also derived from a third audio signal applied to the matrix, the first and second received signals having phase relationships such that, over at least a portion of the audio spectrum, relative to the phase of received signals derived from said third signal applied to the matrix, the phases of received signals derived from the first and second signals applied to the matrix, respectively, are shifted substantially by 45 degrees in opposite directions, and applying the first and second received signals to an active matrix audio decoder that functions substantially as a passive matrix decoder when the two signals applied are about 90 degrees out of phase with respect to each other, or, alternatively, applying the first and second received signals to a passive matrix audio decoder.

Also in accordance with the second aspect of the present invention, an audio signal decoding method comprises receiving first and second received audio signals produced by an audio encoding matrix, wherein the first received audio signal is derived from a first audio signal applied to the matrix, the second received audio signal is derived from a second audio signal applied to the matrix, and the first and second received audio signals are also derived from a third audio signal applied to the matrix, the first and second received signals having phase relationships such that, over at least a portion of the audio spectrum, relative to the phase of received signals derived from said third signal applied to the matrix, the phases of received signals derived from the first and second signals applied to the matrix, respectively, are shifted substantially by 45 degrees in opposite directions, and decoding said first and second received signals using an active matrix audio decoder that functions substantially as a passive matrix decoder when the two signals are about 90 degrees out of phase with respect to each other, or, alternatively, decoding said first and second received signals using a passive matrix audio decoder.

Further in accordance with the second aspect of the present invention, an audio signal decoding method comprises applying to an active matrix audio decoder that functions substantially as a passive matrix decoder when the two signals are about 90 degrees out of phase with respect to each other first and second received audio signals produced by an audio encoding matrix, wherein the first received audio signal is derived from a first audio signal applied to the matrix, the second received audio signal is derived from a second audio signal applied to the matrix, and the first and second received audio signals are also derived from a third audio signal applied to the matrix, the first and second received signals having phase relationships such that, over at least a portion of the audio spectrum, relative to the phase of received signals derived from said third signal applied to the matrix, the phases of received signals derived from the first and second signals applied to the matrix, respectively, are shifted substantially by 45 degrees in opposite directions.

In accordance with the third aspect of the present invention, an audio encoding and decoding system comprises an encoder, the encoder including at least three audio signal inputs: input one, input two and input three; at least two audio signal outputs: output one and output two; an audio matrix, the matrix feeding signals applied to input one substantially only to output one, input two substantially only to output two, and input three substantially equally to outputs one and two, the signals at the outputs having phase relationships such that, over at least a portion of the audio spectrum, relative to the phase of output signals derived from said third input, the phases of signals derived from the first and second inputs, respectively, are shifted substantially by 45 degrees in opposite directions, and a decoder, the decoder including a two-input active matrix audio decoder of the type that functions substantially as a passive matrix decoder when the two signals applied are about 90 degrees out of phase with respect to each other, said matrix decoder receiving signals from said output one and said output two.

Further in accordance with the third aspect of the present invention, an audio encoding and decoding system comprises an encoder, the encoder including at least three audio signal inputs: input one, input two and input three; at least two audio signal outputs: output one and output two; an audio matrix, the matrix feeding signals applied to input one substantially only to output one, input two substantially only to output two, and input three substantially equally to outputs one and two, the signals at the outputs having phase relationships such that, over at least a portion of the audio spectrum, relative to the phase of output signals derived from said third input, the phases of signals derived from the first and second inputs, respectively, are shifted substantially by 45 degrees in opposite directions, and a decoder, the decoder including a two-input passive matrix audio decoder, said matrix decoder receiving signals from said output one and said output two.

DESCRIPTION OF THE PREFERRED EMBODIMENTS

Figure 6:
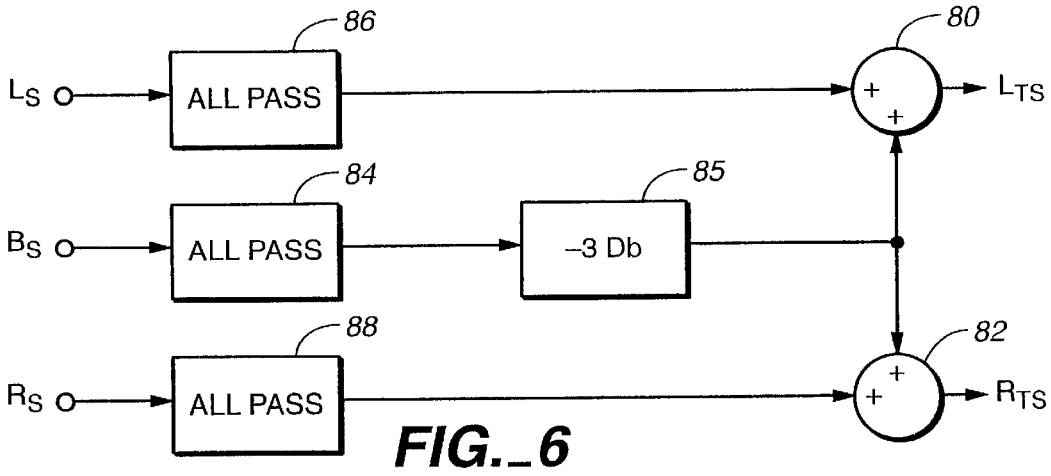
FIG. 6 is an idealized functional block diagram of a new MP Matrix encoder in accordance with one aspect of the present invention.

FIG. 6 is an idealized functional block diagram of a new MP matrix encoder according to one aspect of the present invention. The encoder accepts three separate input signals; left surround ($L_S$), back surround ($B_S$), and right surround ($R_S$), and creates two final outputs, left-total surround ($L_{TS}$) and right-total surround ($R_{TS}$). The $B_S$ input is divided equally and additively summed with the $L_S$ and $R_S$ inputs (in combiners 80 and 92, respectively) with a 3 dB level reduction (a multiplier of 0.707 provided by attenuator 85) in order to maintain constant acoustic power among the three outputs of the decoder. Prior to their respective summations in combiners 80 and 82 (and the attenuation of $B_S$ by attenuator 85), the $L_S$ input is phase shifted in a first all-pass network 86, the $R_S$ input is phase shifted in a second all-pass network 88, and the $B_S$ input is phase shifted in a third all-pass network 84. The order of the attenuator 85 and all-pass network 84 may be reversed The output of combiner 80 provides the encoder's $L_{TS}$ output and the output of combiner 82 provides the encoder's $R_{TS}$ output.

As is well known, two all-pass networks, each typically providing very large phase shifts (hundreds of degrees) may be designed to provide substantially constant frequency-independent phase shift difference over at least a portion of the audio frequency spectrum.

Figure 7:
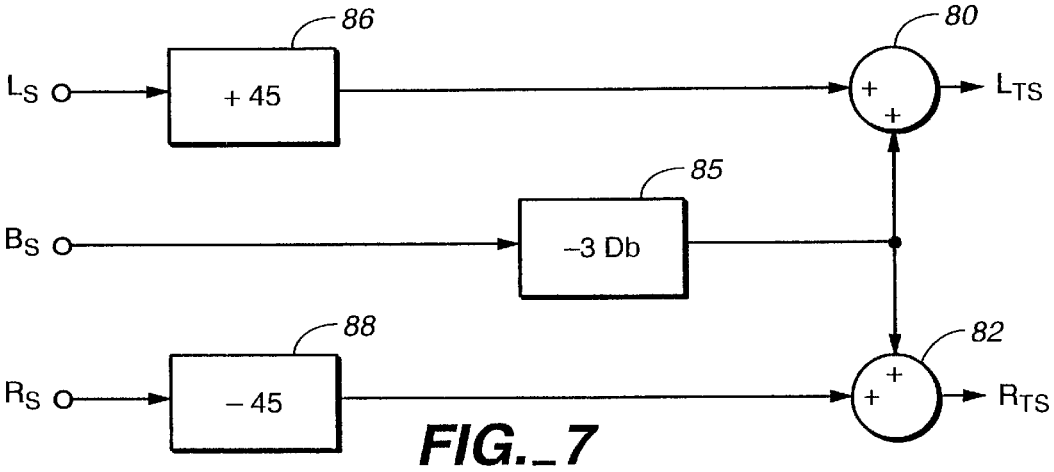
FIG. 7 is an idealized theoretical functional block diagram of a new MP Matrix encoder in accordance with one aspect of the present invention.

It is desired that the $L_{TS}$ and $R_{TS}$ signals have phase relationships such that, over at least a portion of the audio spectrum, relative to the phase of output signals derived from the $B_S$ input, the phases of signals derived from the $L_S$ and $R_S$ inputs, respectively, are shifted substantially by 45 degrees in opposite directions. In principle, this may be accomplished by phase shifts of substantially +45 degrees and substantially −45 degrees (or vice-versa) in the $L_S$ and $R_S$ input paths and no phase shift in the $B_S$ input path. This theoretical arrangement is shown in FIG. 7. In practice, however, a 45 degree phase shifter is unrealizable, so phase shifting is achieved by applying a signal to three phase-shifting processes, producing three signals whose relative phase differences are sufficiently close to the desired phase shift over at least a substantial part of the frequency band of interest. Suitable phase shifting processes are all-pass networks, such as networks 84, 86 and 88. The networks are designed so that each provides very large phase shifts throughout the audio spectrum but that their relative phase shifts, at least throughout the portion of the audio spectrum in which typical active matrix decoders are most sensitive to phase, provide a +45 degree phase shift in the $L_S$ input path with respect to the $B_S$ input path and a −45 degree phase shift in the $R_S$ input path with respect to the $B_S$ input path (or vice-versa).

Satisfactory audible results may be achieved, using very low computer processing power (in the case of a digital/software implementation), to implement one or two of the phase shifting processes by a first order all-pass filter and the other phase shifting process by only a short time delay (which also has an all-pass characteristic). More accurate phase shifting may be achieved by adding, in series, one or more all-pass filters in each phase shifting process and/or by using higher order all-pass filters.

Active matrix decoders contain bandpass filters in their control circuitry to prevent the signals at extremes of the audio spectrum from causing steering. Thus, the encoder phase shifters should provide reasonably accurate phase response within the frequencies passed by that decoder bandpass filter, typically from about 200 Hz to about 5 kHz in a Pro Logic decoder. It is permissible to allow the phase shift to depart from the ideal outside this frequency range, with economies in complexity and cost, particularly in analog realizations. In addition, the relative phase shifts of +45 degrees and −45 degrees within the frequency range in which the decoder is most sensitive are not critical. Variations from the optimum values are acceptable provided that the steering action (variable matrix action departing from the active decoder's passive matrix mode) does not become noticeably audible to an audience. Some steering behind the head is likely not to be perceived by listeners due to the human ear's relative insensitivity to rearward-originating sounds compared to the ear's sensitivity to forward-originating sounds. Moreover, surround sound channels are not presented to listeners as point sources of sound, further masking minor steering actions. In designing phase-shift networks, either analog or digital, there is a trade-off between on the one hand cost and complexity and on the other constancy of phase shift with frequency, the width of the band over which that shift is realized, and flatness of amplitude response. Thus in practical implementations of the encoder according to the present invention, design goals should be to achieve a) flat frequency response, b) reasonably accurate phase shifting, perhaps within 5 or 10 degrees, over typically 200 Hz to 5 kHz, and c) and allow wider tolerance in phase response outside this range. Real circuits are unlikely to have phase shifting so inaccurate outside the band of interest as to give serious errors in response.

Expressing a 90 degree shift by the imaginary number j, a +45 degree shift involves multiplying by 0.707(1+j) and a −45 degree shift by 0.707(1−j). Hence, referring to the relative phase shifts (rather than the large phase shifts required by the practical all-pass networks required to realize the encoder), the encoding can be expressed as:

$$L_{TS}=0.707(1-j)L_S+0.707B_S$$

$$R_{TS}=0.707(1+j)R_S+0.707B_S$$

This encoder, feeding an active decoder of the type already in common use for analog stereo optical soundtracks, will deliver a surround source from any one of the loudspeaker banks by feeding one of the encoder inputs. If a source is fed into the $L_S$and $R_S$ inputs, either in phase or in opposite polarity, that source will emerge from all surround loudspeakers. To pan a source from say left to back to right requires a pan from left to back, and then from back to right. Panning from left to right omitting the back input will move a sound smoothly from the left only via all loudspeakers to the right only. In all cases, the resultant $L_{TS}$ and $R_{TS}$ are compatible with conventional 5.1-channel or 7.1-channel reproduction with only two banks of surround loudspeakers.

Figure 1:
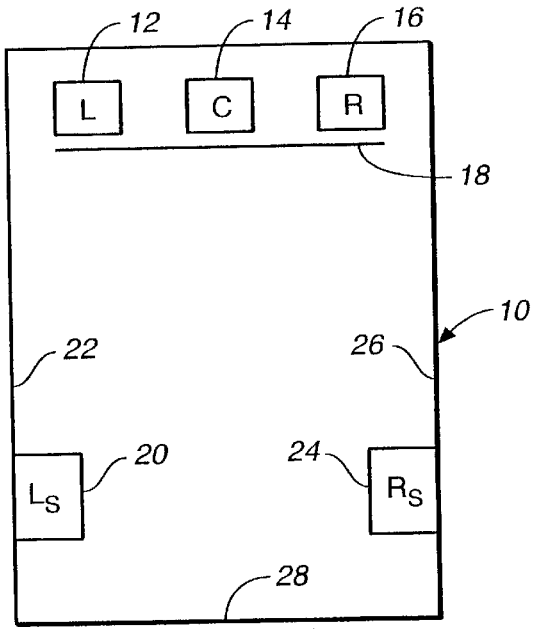
FIG. 1 is a schematic plan view of a motion picture theater showing idealized loudspeaker locations for reproducing left (L), center (C), right (R), left surround ($L_S$) and right surround ($R_S$) motion picture soundtrack channels such as are provided by Dolby Digital and DTS digital soundtracks.
Figure 2:
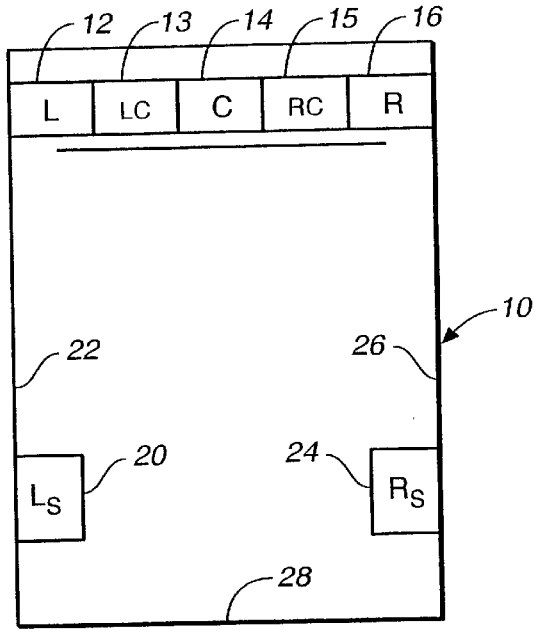
FIG. 2 is a schematic plan view of a motion picture theater showing idealized loudspeaker locations for reproducing left (L), left center (LC), center (C), right center (RC), right (R), left surround ($L_S$) and right surround ($R_S$) motion picture soundtrack channels such as are provided by Sony SDDS digital soundtracks.
Figure 3:
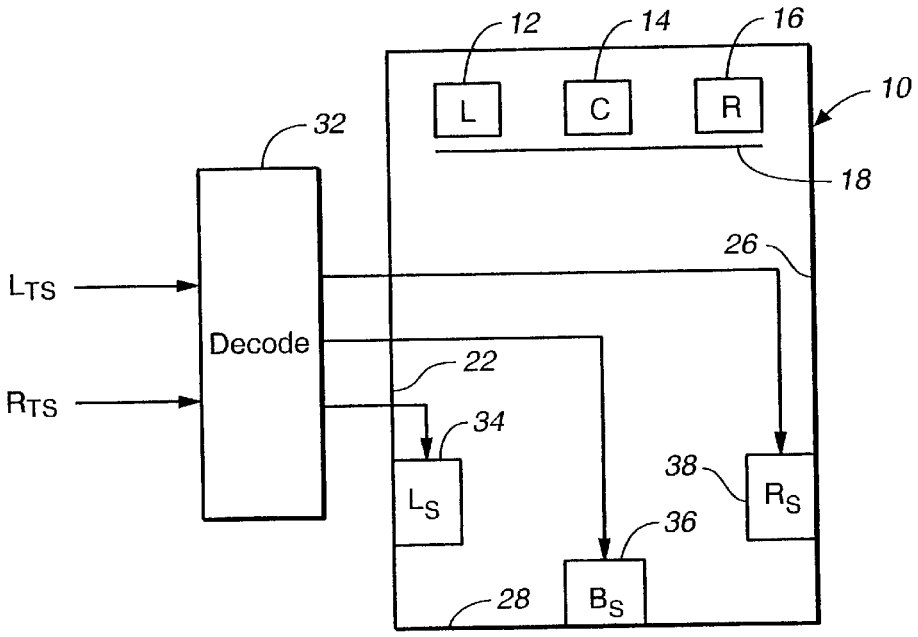
FIG. 3 is a schematic plan view of a motion picture theater showing an idealized loudspeaker arrangement according to a three surround channel embodiment of a copending application assigned to the assignee of the present application.
Figure 4:
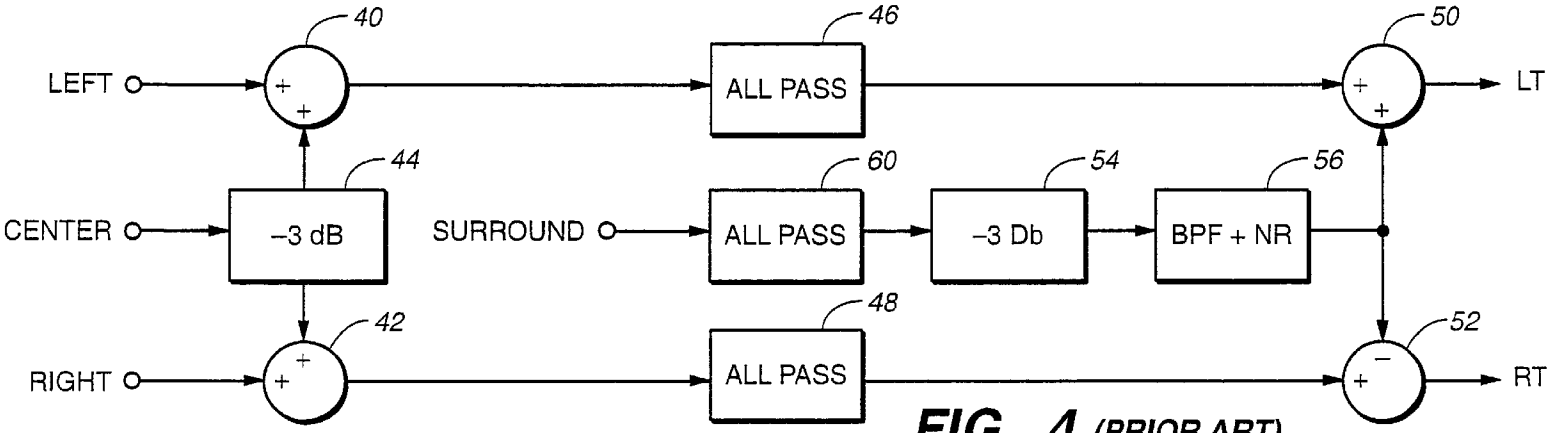
FIG. 4 (PRIOR ART)
FIG. 4 is an idealized functional block diagram of a conventional prior art Dolby MP Matrix encoder.
Figure 5:
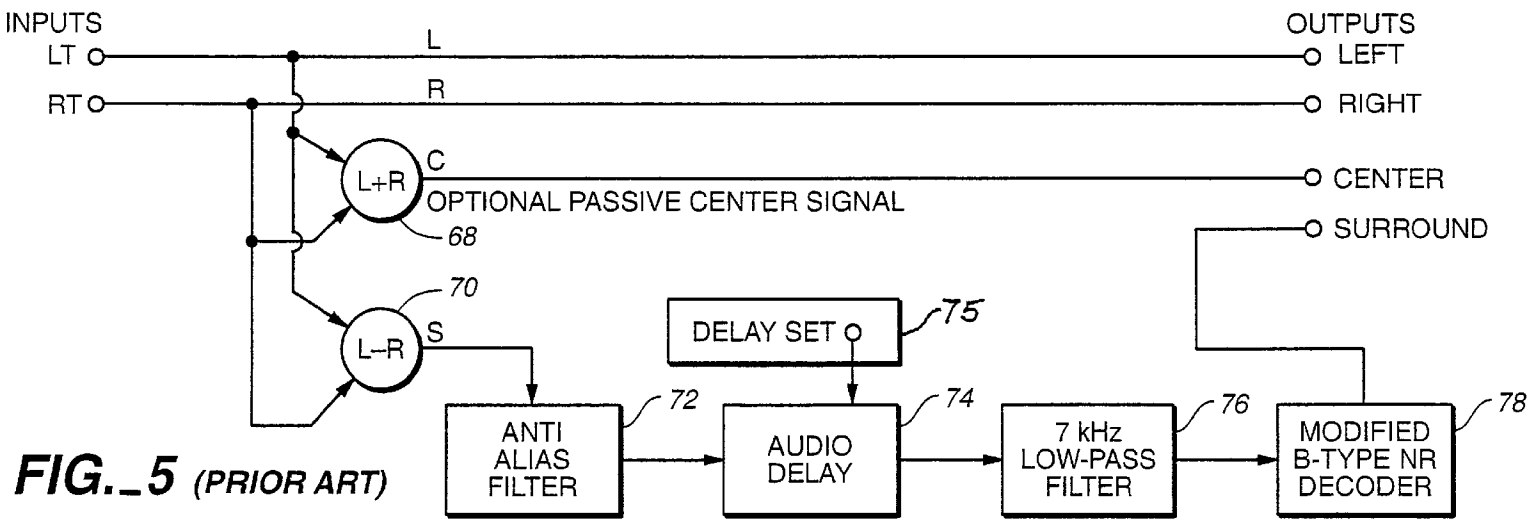
FIG. 5 (PRIOR ART)
FIG. 5 is an idealized functional block diagram of a prior art passive surround decoder suitable for decoding Dolby MP matrix encoded signals.
Figure 8:
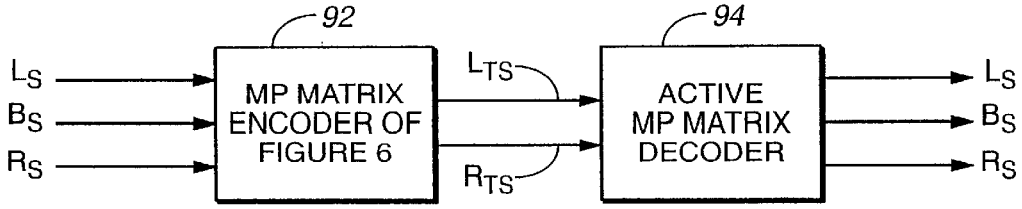
FIG. 8 is a functional block diagram of a system in accordance with another aspect of the present invention, the system employing a new MP Matrix encoder in accordance with one aspect of the present invention and an active matrix decoder.

FIG. 8 is a functional block diagram of a system in accordance with another aspect of the present invention, showing a new MP Matrix encoder as described in the embodiment of FIG. 6 in combination with an active matrix decoder. The $L_{TS}$ and $R_{TS}$ outputs of the encoder are carried by the right surround and left surround channels in any of the three Dolby Digital, Sony SDDS and DTS digital motion picture soundtrack systems (or any future digital motion picture soundtrack system) for decoding by an active MP audio matrix decoder 94. It will be understood that appropriate encoding and decoding for the respective digital soundtrack system is employed in the paths between the encoder and decoder. As discussed above, the active matrix decoder is preferably a Pro Logic decoder, although other active matrix decoders may be usable provided that they operate as passive matrix decoders under the conditions of input signal phase discussed above. The $L_S$, $B_S$ and $R_S$ outputs are applied to respective surround loudspeakers or banks of loudspeakers in the manner of the FIG. 3 environment.

Figure 9:
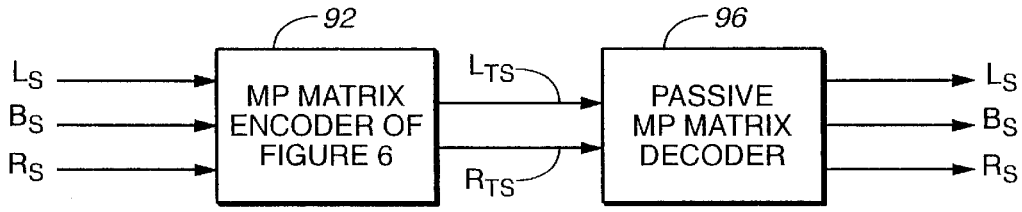
FIG. 9 is a functional block diagram of a system in accordance with another aspect of the present invention, the system employing a new MP Matrix encoder in accordance with one aspect of the present invention and a passive matrix decoder.

FIG. 9 is a functional block diagram of a system in accordance with the same aspect of the present invention as FIG. 7, showing a new MP Matrix encoder as described in the embodiment of FIG. 6 in combination with a passive matrix decoder. The $L_{TS}$ and $R_{TS}$ outputs of the encoder are carried by the right surround and left surround channels in any of the three Dolby Digital, Sony SDDS and DTS digital motion picture soundtrack systems (or any future digital motion picture soundtrack system) for decoding by a passive MP audio matrix decoder 96. It will be understood that appropriate encoding and decoding for the respective digital soundtrack system is employed in the paths between the encoder and decoder. As discussed above, although the active matrix decoder is preferably a Pro Logic decoder, a passive decoder is usable. The $L_S$, $B_S$ and $R_S$ outputs are applied to respective surround loudspeakers or banks of loudspeakers in the manner of the FIG. 3 environment.

The present invention may be implemented using analog, digital, hybrid analog/digital and/or digital signal processing in which functions are performed in software and/or firmware. Although described in connection with Dolby Digital, Sony SDDS and DTS digital motion picture soundtrack systems, the present invention may also be used in connection with other digital or analog format mediums, such as motion picture film, magnetic tape, optical disc (including, but not limited to DVD), or magneto-optical disc carrying discrete channels in which two discrete surround-sound channels are matrix encoded with three surround-sound channels.

It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

I claim:

1. An audio encoder, comprising at least three audio signal inputs: input one, input two and input three;

at least two audio signal outputs: output one and output two;

an audio matrix, the matrix feeding signals applied to input one substantially only to output one, input two substantially only to output two, and input three substantially equally to outputs one and two, the signals at said outputs having phase relationships such that, over at least a portion of the audio spectrum, relative to the phase of output signals derived from said third input, the phases of signals derived from the first and second inputs, respectively, are shifted substantially by 45 degrees in opposite directions.

2. An audio encoder according to claim 1, wherein said encoder is for encoding surround sounds for subsequent reproduction via an active surround matrix decoder for playing into three loudspeakers or banks of loudspeakers (to the left rear, back and right rear of an audience), said first and second signal inputs constituting inputs for left surround and right surround signals, respectively, said third signal input constituting an input for a back surround signal, said first signal output constituting a left total surround signal output and said second signal output constituting a right total surround signal output.

3. An audio encoder according to claim 2, wherein the output signals produced by said audio matrix are substantially in accordance with the recited phase relationships at least for signals within the range in which said active surround matrix decoder is most sensitive to signal phase.

4. An audio encoder according to claim 2, wherein the output signals produced by said audio matrix are substantially in accordance with the recited phase relationships at least for signals within the range of about 200 Hz to about 5 kHz.

5. An audio encoder according to claim 1, wherein the signals applied to said first and second signal inputs may be designated $L_S$ and $R_S$, respectively, the signal applied to said third signal input may be designated $B_S$, the signal at said first output may be designated $L_{TS}$ and the signal at said second output may be designated $R_{TS}$, such that output signals produced by said audio matrix are substantially in accordance with the relationships $$L_{TS}=0.707(1-j)L_S+0.707B_S, \text{ and}$$

$$R_{TS}=0.707(1+j)R_S+0.707B_S,$$

or $$L_{TS}=0.707(1+j)L_S+0.707B_S, \text{ and}$$

$$R_{TS}=0.707(1-j)R_S+0.707B_S,$$

throughout at least a portion of the audio spectrum, wherein 0.707(1−j) indicates a phase shift of −45 degrees and 0.707 (1+j) indicates a phase shift of +45 degrees.

6. An audio encoder according to claim 5, wherein the output signals produced by said audio matrix are substantially in accordance with the recited phase relationships at least for signals within the range in which said active surround matrix decoder is most sensitive to signal phase.

7. An audio encoder according to claim 5, wherein the output signals produced by said audio matrix are substantially in accordance with the recited phase relationships at least for signals within the range of about 200 Hz to about 5 kHz.

8. An audio encoder according to claim 5, wherein said encoder is for encoding surround sounds for subsequent reproduction via an active surround matrix decoder for playing into three loudspeakers or banks of loudspeakers (to the left rear, back and right rear of the audience), said $L_S$ and $R_S$ signal inputs constituting inputs for left surround and right surround signals, respectively, said $B_S$ signal input constituting an input for a back surround signal, said $L_{TS}$ signal output constituting a left total surround signal output and said $R_{TS}$ signal output constituting a right total surround signal output.

9. An audio encoder according to claim 8, wherein the output signals produced by said audio matrix are substantially in accordance with the recited phase relationships at least for signals within the range in which said active surround matrix decoder is most sensitive to signal phase.

10. An audio encoder according to claim 8, wherein the output signals produced by said audio matrix are substantially in accordance with the recited phase relationships at least for signals within the range of about 200 Hz to about 5 kHz.

11. An audio encoder according claim 1, wherein said audio matrix comprises a first additive combiner having two inputs and an output, a second additive combiner having two inputs and an output, a signal amplitude attenuator reducing the amplitude of an input signal by a factor of about 0.707, a first all-pass network having its input coupled to said first input and having its output coupled to one input of said first additive combiner, a second all-pass network having its input coupled to said second input and having its output coupled to one input of said second additive combiner, a third all-pass network, including said attenuator, having its input coupled to said third input and having its output coupled to the other input of said first additive combiner and to the other input of said second additive combiner, said third all-pass network, over at least a portion of the audio spectrum, having a relative phase shift of about +45 degrees with respect to the phase shift of said first all-pass network and a relative phase shift of about −45 degrees with respect to the phase shift of said second all-pass network, or said third all-pass network having a relative phase shift of about −45 degrees with respect to the phase shift of said first all-pass network and a relative phase shift of about +45 degrees with respect to the phase shift of said second all-pass network, whereby, over at least a portion of the audio spectrum, said first all-pass network has a relative phase shift of about 90 degrees with respect to the phase shift of said second all-pass network.

12. An audio encoder according to claim 11, wherein the output signals produced by said audio matrix are substantially in accordance with the recited phase relationships at least for signals within the range in which said active surround matrix decoder is most sensitive to signal phase.

13. An audio encoder according to claim 11, wherein the relative phase shifts of said all-pass networks with respect to each other are substantially in accordance with the recited phase relationships at least for signals within the range of about 200 Hz to about 5 kHz.

14. An audio signal decoding method, comprising receiving first and second received audio signals produced by an audio encoding matrix, wherein the first received audio signal is derived from a first audio signal applied to the matrix, the second received audio signal is derived from a second audio signal applied to the matrix, and the first and second received audio signals are also derived from a third audio signal applied to the matrix, the first and second received signals having phase relationships such that, over at least a portion of the audio spectrum, relative to the phase of received signals derived from said third signal applied to the matrix, the phases of received signals derived from the first and second signals applied to the matrix, respectively, are shifted substantially by 45 degrees in opposite directions, and applying said first and second received signals to an active matrix audio decoder that functions substantially as a passive matrix decoder when the two signals applied are about 90 degrees out of phase with respect to each other.

15. An audio signal decoding method, comprising receiving first and second received audio signals produced by an audio encoding matrix, wherein the first received audio signal is derived from a first audio signal applied to the matrix, the second received audio signal is derived from a second audio signal applied to the matrix, and the first and second received audio signals are also derived from a third audio signal applied to the matrix, the first and second received signals having phase relationships such that, over at least a portion of the audio spectrum, relative to the phase of received signals derived from said third signal applied to the matrix, the phases of received signals derived from the first and second signals applied to the matrix, respectively, are shifted substantially by 45 degrees in opposite directions, and applying said first and second received signals to a passive matrix audio decoder.

16. An audio signal decoding method, comprising receiving first and second received audio signals produced by an audio encoding matrix, wherein the first received audio signal is derived from a first audio signal applied to the matrix, the second received audio signal is derived from a second audio signal applied to the matrix, and the first and second received audio signals are also derived from a third audio signal applied to the matrix, the first and second received signals having phase relationships such that, over at least a portion of the audio spectrum, relative to the phase of received signals derived from said third signal applied to the matrix, the phases of received signals derived from the first and second signals applied to the matrix, respectively, are shifted substantially by 45 degrees in opposite directions, and decoding said first and second received signals using an active matrix audio decoder that functions substantially as a passive matrix decoder when the two signals are about 90 degrees out of phase with respect to each other.

17. An audio signal decoding method, comprising receiving first and second received audio signals produced by an audio encoding matrix, wherein the first received audio signal is derived from a first audio signal applied to the matrix, the second received audio signal is derived from a second audio signal applied to the matrix, and the first and second received audio signals are also derived from a third audio signal applied to the matrix, the first and second received signals having phase relationships such that, over at least a portion of the audio spectrum, relative to the phase of received signals derived from said third signal applied to the matrix, the phases of received signals derived from the first and second signals applied to the matrix, respectively, are shifted substantially by 45 degrees in opposite directions, and decoding said first and second received signals using a passive matrix audio decoder.

18. An audio signal decoding method, comprising applying to an active matrix audio decoder that functions substantially as a passive matrix decoder when the two signals are about 90 degrees out of phase with respect to each other, first and second received audio signals produced by an audio encoding matrix, wherein the first received audio signal is derived from a first audio signal applied to the matrix, the second received audio signal is derived from a second audio signal applied to the matrix, and the first and second received audio signals are also derived from a third audio signal applied to the matrix, the first and second received signals having phase relationships such that, over at least a portion of the audio spectrum, relative to the phase of received signals derived from said third signal applied to the matrix, the phases of received signals derived from the first and second signals applied to the matrix, respectively, are shifted substantially by 45 degrees in opposite directions.

19. An audio encoding and decoding system, comprising an encoder, said encoder including at least three audio signal inputs: input one, input two and input three;

at least two audio signal outputs: output one and output two;

an audio matrix, the matrix feeding signals applied to input one substantially only to output one, input two substantially only to output two, and input three substantially equally to outputs one and two, the signals at said outputs having phase relationships such that, over at least a portion of the audio spectrum, relative to the phase of output signals derived from said third input, the phases of signals derived from the first and second inputs, respectively, are shifted substantially by 45 degrees in opposite directions, and a decoder, said decoder including a two-input active matrix audio decoder of the type that functions substantially as a passive matrix decoder when the two signals applied are about 90 degrees out of phase with respect to each other, said matrix decoder receiving signals from said output one and said output two.

20. An audio encoding and decoding system, comprising an encoder, said encoder including at least three audio signal inputs: input one, input two and input three;

at least two audio signal outputs: output one and output two;

an audio matrix, the matrix feeding signals applied to input one substantially only to output one, input two substantially only to output two, and input three substantially equally to outputs one and two, the signals at said outputs having phase relationships such that, over at least a portion of the audio spectrum, relative to the phase of output signals derived from said third input, the phases of signals derived from the first and second inputs, respectively, are shifted substantially by 45 degrees in opposite directions, and a decoder, said decoder including a two-input passive matrix audio decoder, said matrix decoder receiving signals from said output one and said output two.

* * * * *